United States Patent [19]

Wun-chung

[11] Patent Number: 4,819,916

[45] Date of Patent: Apr. 11, 1989

[54] SYSTEM OF REPLACEABLE ROAD RAILING

[76] Inventor: Kwou Wun-chung, FL. 3-1, No. 306, Hsing I Rd. Sec. 4, Taipei, Taiwan

[21] Appl. No.: 149,018

[22] Filed: Jan. 27, 1988

[51] Int. Cl.[4] ..... A01K 3/00

[52] U.S. Cl. ..... 256/13.1; 256/19; 52/297; 248/66

[58] Field of Search ..... 256/13.1, 19; 52/297, 52/298; 248/66

[56] References Cited

U.S. PATENT DOCUMENTS

| | | | |
|---|---|---|---|
| 1,805,731 | 5/1931 | Beckwith | 52/298 |
| 2,784,015 | 3/1957 | Swanson | 52/298 X |
| 3,335,534 | 8/1967 | Hester et al. | 256/13.1 X |
| 3,579,936 | 5/1971 | Andersson et al. | 52/297 |

*Primary Examiner*—Andrew V. Kundrat

*Attorney, Agent, or Firm*—Morton J. Rosenberg

[57] ABSTRACT

This invention, being an improvement on the kind of fixed road railing adopted widely now, provides a new system of replaceable road railing comprising mainly of an underground sleeve, into which a pillar is inserted, a pillar with blades at its bottom, and a device inside the pillar which, by means of its upward and downward movement, controls the expanding and contracting movement of the blades of the pillar and, as a result, causes the blades to tighten against or loosen from the inner surface of the sleeve and, thus the pillar can be easily inserted into the sleeve or taken out from it thereby.

4 Claims, 4 Drawing Sheets

SYSTEM OF REPLACEABLE ROAD RAILING

BACKGROUND OF THE INVENTION

Alongside the dangerous roads as those by the coast or those in the mountains and highways or freeways, road railing of various height and size, according to the necessity of the design of the roads, have to be set up to ensure the safety of driving by way of preventing cars from crashing with those in the opposite direction or from falling down the cliffs and thereby minimize casualties resulted from driving accidents.

The road railing adopted widely now comprises of pillars, with their lower part made of steel bars and cement, being fixed underground and rails, in parallel horizontally to road surface, connecting the pillars.

The road railing which bears the function to minimize casualties resulted from driving accidents is subject to frequent damage that necessitates repair which, if undertaken in traditional way, is indeed troublesome and time-wasting in that cement remained attaching to the steel bars of the damaged pillars has to be clear away first, and those bent steel bars of the damaged pillars have to be straightened thereafter, and wooden boards have to be set up around those straightened steel bars thereafter, and cement has to be poured into the area surrounded by wooden boards in order to have the repaired or new pillars fixed underground thereafter, and ten to twenty days have to be spent on waiting for the cement to become dry thereafter, and those wooden boards will be removed and pillars connected with rails at last.

Since much time has to be spent on repairing those damaged pillars and part of the road blocked during the repair, traffic jam can hardly be avoided and the possibility of traffic accident will be increased.

Furthermore, that kind of fixed road railing cannot be guaranteed to carry out its function well after a certain period of time as the road will be asphalted, if necessary, in order to maintain a good condition of the road surface and thereby, though the road base will be consolidated, the standard in height of the road railing, (for instance, must be 85 cm above the road surface), will be lowered.

SUMMARY OF THE INVENTION

The present invention overcomes the defect of inconvenience in installing and maintaining road railing, since pillars in this new system of road railing can be taken out and replaced without difficulty in a short period of time.

Moreover, the present invention is more durable than that kind of fixed road railing, as the height of road railing in the new system can be adjusted according to necessity simply by placing steel blocks inside the sleeves, so the maintenance of road surface, on which layers of asphalt may be spread when necessary, will not cause the height of road railing to become lower and affect its function.

Evitably, the new system of replaceable road railing is more convenient and more efficient in installing and maintaining than the fixed road railing system as well as more durable and hence more practical too; and, therefore, the total effect is more economical.

The advantages and objects of the invention will become evident from the following detailed description when read in connection with the accompanying diagrams which illustrate preferred embodiments of the invention.

BRIEF DESCRIPTION OF THE DIAGRAMS

DETAILED DESCRIPTION OF THE PREFERRED EMBODIMENTS

Figure 1:
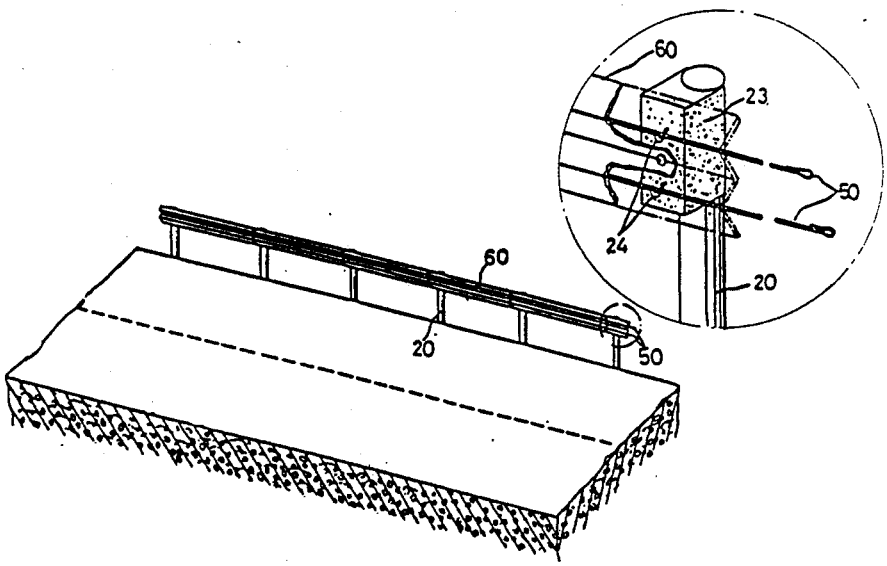
FIG. 1 is a perspective view of the preferred embodiment of the invention.
Figure 2:
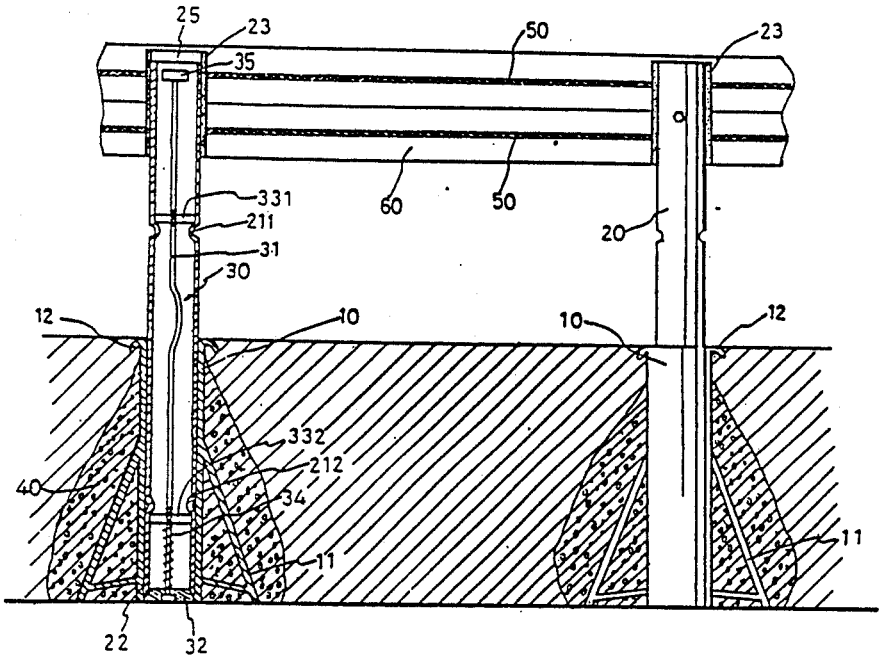
FIG. 2 is a vertical view of the structure of the preferred embodiment of the invention.

Referring now to FIGS. 1 and 2, there is shown a replaceable road railing system which includes a sleeve member 10 extending in the vertical direction from a lower end beneath the ground surface to an upper end which is shown in FIG. 2 to be adjacent the ground surface. Sleeve member 10 is tubular in contour and is adapted for the insert of pillar member 20 therein as is clearly seen in FIGS. 2–4. Additionally, replacement and adjustment mechanism 30 is insertable within tubularly contoured pillar member 20 for purposes and objectives as will be detailed in following paragraphs.

Referring now to sleeve member 10, such includes inclined frame members or prop members 11 which are fixedly secured to the outer surface of the sleeve member 10 near the middle and lower section to insure that sleeve member 10 is fixedly secured in a firm manner beneath the ground surface as is shown. Frame or prop members 11 may be formed in one piece construction with sleeve member 10, or may be otherwise secured thereto in a fixed manner.

The upper end of sleeve member 10 includes protruding hook members 12 which provides for the upper end of sleeve member 10 to be additionally anchored beneath the road surface and further to increase the surface area to insure that sleeve member 10 may structurally be secure against the normal pressure loadings of the roadway. The vertical height of sleeve member 10 is dependent on the road conditions and in general, the upper end section defining protruding hooks 12 is located contiguous with the level of the road surface, as is shown in FIG. 2.

In order to provide for a strong structural effect for sleeve member 10, prop or inclined frame members 11 extend outwardly at a lower end of sleeve member 10. Additionally, as is clearly seen in FIGS. 2 and 3, a section around inclined frame members 11 and sleeve member 10 is encased in cement 40 to provide a sturdy and high structural integrity for the overall system.

Figure 3:
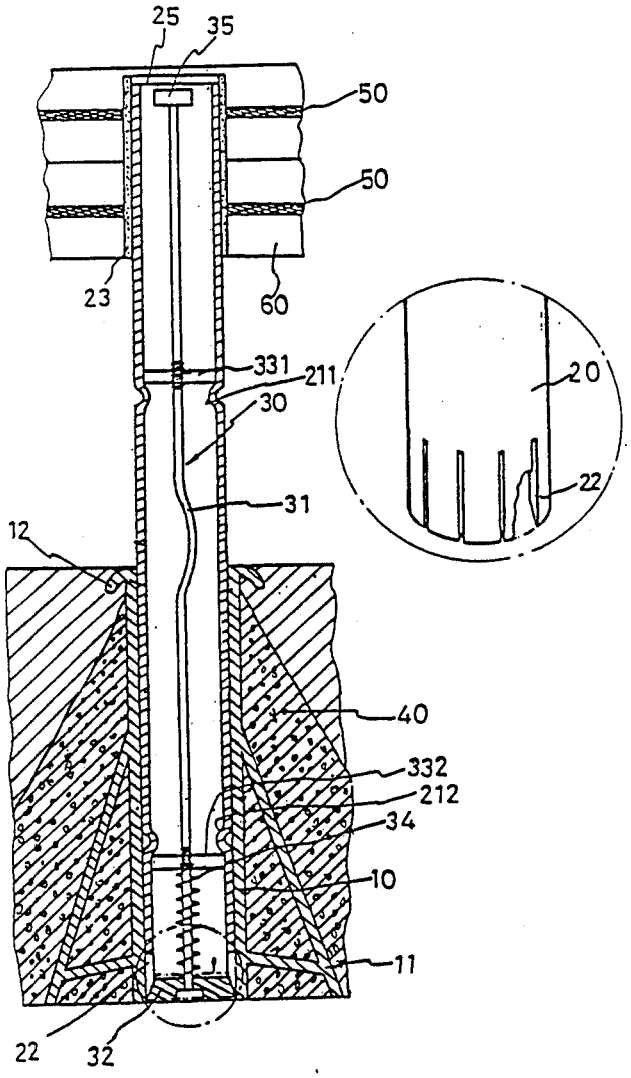
FIG. 3 illustrates how the upward and downward movement of the device inside the pillar controls the expansion and contraction of the blades.
Figure 4:
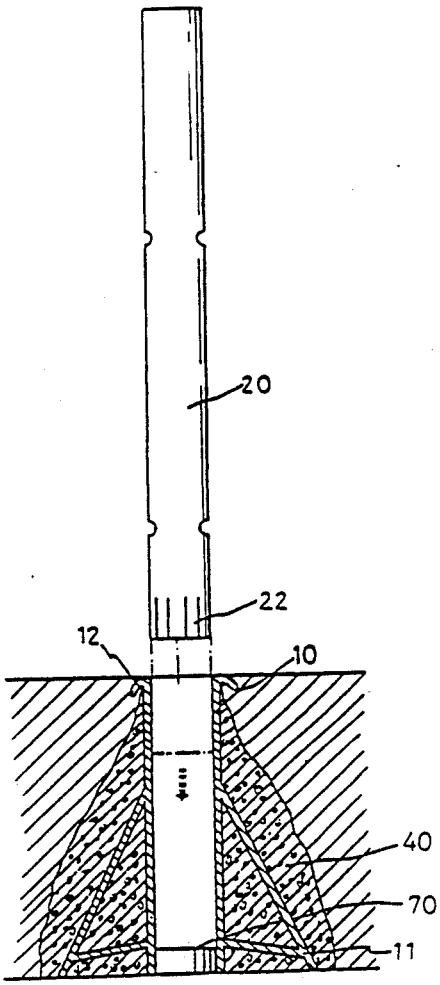
FIG. 4 illustrates the way to take out a pillar from a sleeve and replace it.

Referring now to FIGS. 2, 3 and 4, there is seen substantially hollow tubular pillar member 20 which is insertable into sleeve member 10. Pillar member 20 which has a hollow interior as is seen in FIG. 2, includes a pair of concavities 211 and 212 formed within an external surface of pillar member 20. Concavity 211 is located above the ground surface and concavity 212 is located below the ground surface, as is shown. The lower section of pillar 20 defines a plurality of blade members 22 which define a plurality of fingers displaceable in an outward direction radial with respect to a central axis line of pillar member 20. As will be seen, blades or finger members 22 may be deformed in an outward manner to impinge and frictionally secure pillar member to an inner wall of sleeve member 10.

Pillar member 20 includes an upper section having a cover member 25 which may be mounted on top of pillar member 20 and is removable therefrom at the discretion of a user. Additionally, as is seen in FIGS. 1 and 2, there is provided block member 23 which is fixedly secured to the upper end of pillar member 20. Block member 23 may be fixed to pillar member 20 through adhesive bonding, threaded securement, or some like technique not important to the inventive concept as herein described, with the exception that block 23 be fixedly secured to the upper end of pillar member 20. Extending outward from block member 23 are a pair of protruding hooks 24 which are releasably mounted on a pair of cables 50 as is shown in FIG. 1. Cables 50 lie adjacent undulating steel plate member 60 and provides a mounting base thereof. Replacement and adjusting mechanism 30 is located within pillar member 20 for providing securement to and removal of pillar members 20 from respective sleeve members 30. Replacement and adjustment mechanism 30 includes a vertically extending threaded rod member 31 having an upper end defining rod head member 35 adapted to be rotated. Threaded rod member 31 includes a lower end within the lower section of pillar member 20. Threaded rod 31 is threadedly coupled to upper fixing block member 331 located within pillar member 20 above concavity 211, as is shown in FIG. 3. Similarly, threaded rod 31 is threadedly secured to lower fixing block member 332 formed within pillar member 20 below concavity 212 below the ground surface. Upper and lower fixing block members 331 and 332 are displaceably constrained by respective concavities 211 and 212 to limit the displacement of fixing blocks 331 and 332.

The lower end of threaded rod 31 is secured to wedge member 32, as is seen in FIG. 3. Wedge member 32 has a cross-sectional truncated cone contour and is displaceable upward when rod head member 35 is rotated in a first direction for displacing blade members 22 in an outward radial direction against an inner wall of sleeve member 10. When this happens, blade members 22 frictionally engage the inner wall of the sleeve member 10 and secure pillar member 20 to sleeve member 10 in a force-fit securement. Wedge member 32 may be displaced in a downward direction when rod head 35 is rotated in an opposing second direction to rotational first direction and releases blade members 22 from the inner wall of sleeve member 10 to allow pillar member 20 to be removed from sleeve member 10, thus allowing replacement of pillar member 20 within sleeve member 10.

It is noted in FIG. 3 that the middle portion of threaded rod 31 is arcuate enabling such to have a greater elasticity. However, threaded rod 31 is at all times maintained in an upright position in a constrained relation within pillar member 20 by upper and lower fixing blocks 331 and 332, respectively.

Heavy-duty coil spring 34 is mounted in the segment of threaded rod 31 between the bottom of lower fixing block member 332 and the upper surface of wedge member 32. In this manner, there is a biasing force for pressing lower fixing block 332 against lower concavity 212. Additionally, when new asphalt is laid on the upper ground surface, there may be a need to raise pillar member 20 to adjust for the height of the undulating steel plate members 60. As can be seen in FIG. 4, a predetermined height of steel block member 70 may be inserted within sleeve member 10. When pillar member 20 is then placed within sleeve member 10, pillar member 20 extends upwardly by a distance equivalent to the height of steel block member 70. In this manner, by providing for a steel block member 70 of predetermined height, the adjustment of the height of pillar member 20 may be made accordingly.

In order to set up replaceable road railing systems of the subject invention concept, pillar members 20 are inserted into sleeve members 10 having attached inclined prop or frame members 11. Sleeve members 10 are fixedly and firmly secured beneath the road surface with cement 40 surrounding sleeve members 10 and frame members 11.

At the upper end of each pillar member 20 which is inserted into the sleeve members 10, wooden block 23 is secured in order that hook members 24 hold a pair of wire cables 50 and such are coupled to undulating steel plates 60 which cover wire cables 50.

Referring now to FIGS. 3 and 4, there is illustrated the operation of the present invention of the replaceable road railing system. Initially, sleeve member 10 is buried underground and fixed permanently by surrounding it with cement 40 in order that pillar member 20 is inserted into sleeve member 10 and such may be erected in a vertically upright position.

By attaching a wrench to screw head 35 at the upper end of replacement and adjustment mechanism 30 internal to pillar member 20, the upper and lower fixing blocks 331 and 332 are pressed against respective concavities 211 and 212 formed within pillar member 20. Wedge member 32 moves upwardly to push blade members 22 radially outward so that blade members 22 press tightly against an inner surface of sleeve member 10. Subsequent to this, wire cables 50 are hooked to wooden block 23 by hook members 24 and undulating steel plates 60 are fastened to pillar members 20.

Pillar members 20 may be removed and replaced by removal of cover member 25 at the upper end of pillar member 20. Once again, with a wrench securement, threaded rod member 31 is rotated in a second direction opposite to the first rotational direction whereby fixing blocks 331 and 332 are displaced away from respective concavities 211 and 212 of pillar member 20. Wedge member 32 moves downwardly and blade members 22 are detached from the inner surface of sleeve member 10. Thus, pillar member 20 is separated from sleeve member 10 and is free to be vertically removed and replaced.

In conclusion, there is only needed a wrench to manipulate replacement and adjustment mechanism 30. In this manner, wedge member 32 may either be driven upwardly or downwardly in a vertical direction through rotational actuation of threaded rod member 31. In this manner, blades may be pressed against an inner surface of sleeve member 10 or detached therefrom and pillar member 20 may be removed or secured responsive to rotation of screw head 35.

The foregoing Description and Figures are provided to explain and illustrate the invention however, the invention is not to be limited thereto, since those skilled in the art who have the disclosure before them will be able to make modifications and variations therein without departing from the spirit or scope of the invention.

What is claimed is:

1. A replaceable road railing system comprising:

(a) a sleeve member extending from a lower end beneath a ground surface to an upper end adjacent said ground surface, said sleeve member having inclined frame members secured to a lower portion of said sleeve member beneath said ground surface, said frame members being encased in cement;

(b) a substantially hollow tubular pillar member insertable into said sleeve member, said pillar member having a pair of concavities formed within an external surface, one of said concavities being located above said ground surface and the other of said concavities being located below said ground surface, said pillar member having a lower section defining a plurality of blade members, and an upper section having a cover member and a block member fixedly secured thereto, said block member for interfacing with and coupling an undulating steel plate member to said pillar member; and, (c) replacement and adjustment means located within said pillar member for providing securement to and removal of said pillars from said sleeve member, said replacement and adjustment means including an extended threaded rod, said threaded rod having an upper end defining a rod head member and a lower end located within said lower section of said pillar member, said threaded rod being threadedly coupled to an upper fixing block member located within said pillar member above said concavity formed above said ground surface and to a lower fixing block member located within said pillar member below said concavity formed below said ground surface, said upper and lower fixing block members being displaceably constrained by respective concavities, said lower end of said threaded rod being secured to a wedge member having a truncated cone contour, said wedge member being displaced upwardly when said rod head member is rotated in a first direction for displacing said blade members in an outward radial direction against an inner wall of said sleeve member for securing said pillar member to said sleeve member, said wedge member being displaced downwardly when said rod head member is rotated in a second direction for releasing said blade members from said inner wall of said sleeve member to allow said pillar member to be removed from said sleeve member.

2. The replaceable road railing system as recited in claim 1 including a pair of block hook members fixedly secured to said block member and extending therefrom, each of said block hook members for releasable coupling to a respective cable member extending adjacent said undulating steel plate member.

3. The replaceable road railing system as recited in claim 1 where said sleeve member includes a protruding hook member forming an upper end thereof for anchoring said sleeve member below said ground surface.

4. The replaceable road railing system as recited in claim 1 including an adjustment block of predetermined height insertable into said sleeve member, said pillar member being raised by said predetermined height for adjusting to a raising of said road surface.

* * * * *